US006799350B1

(12) United States Patent
Gordon

(10) Patent No.: US 6,799,350 B1
(45) Date of Patent: Oct. 5, 2004

(54) SUCTION-ASSISTED DUSTING DEVICE

(76) Inventor: Ellis David Gordon, 2801 Quebec Street, NW., Apt. 243, Washington, DC (US) 20008

( * ) Notice: Subject to any disclaimer, the term of this patent is extended or adjusted under 35 U.S.C. 154(b) by 0 days.

(21) Appl. No.: 09/861,519

(22) Filed: May 22, 2001

Related U.S. Application Data

(60) Provisional application No. 60/206,296, filed on May 23, 2000.

(51) Int. Cl.[7] ..... A47L 9/06

(52) U.S. Cl. ..... 15/344; 15/393; 15/396; 15/1.51

(58) Field of Search ..... 15/344, 1.51, 1.52, 15/393, 396, 1.2; 134/24

(56) References Cited

U.S. PATENT DOCUMENTS

| | | | | | |
|---|---|---|---|---|---|
| 1,902,534 | A | * | 3/1933 | Wielatz | 15/396 |
| 2,036,789 | A | * | 4/1936 | Baker | 15/344 |
| 2,198,339 | A | * | 4/1940 | Hamilton | 15/396 |
| 2,206,738 | A | * | 7/1940 | Brock et al. | 15/396 |
| 2,243,120 | A | * | 5/1941 | Pollitt | 15/396 |
| 2,255,271 | A | * | 9/1941 | Rast | 15/396 |
| 2,280,751 | A | * | 4/1942 | Davis | 15/1.51 |
| 2,584,515 | A | * | 2/1952 | Udell | 15/396 |
| 2,606,338 | A | * | 8/1952 | De Lorenzo | 15/396 |
| 4,083,073 | A | * | 4/1978 | Bernardini | 15/1.52 |
| 4,197,610 | A | * | 4/1980 | Schneider | 15/1.51 |
| 4,227,278 | A | | 10/1980 | Raskin et al. | |
| 4,305,173 | A | * | 12/1981 | Isao | 15/1.52 |
| 4,373,224 | A | * | 2/1983 | Bandai et al. | 15/1.52 |
| 4,718,141 | A | | 1/1988 | Kuehnl | |
| 4,827,561 | A | | 5/1989 | Lamore | |
| 4,905,342 | A | | 3/1990 | Ataka | |
| 4,941,230 | A | | 7/1990 | Lamore | |
| 4,956,892 | A | * | 9/1990 | Fawkes | 15/344 |
| 4,972,541 | A | | 11/1990 | Smith, Jr. | |
| 5,123,142 | A | * | 6/1992 | Miller | 15/396 |
| 5,134,752 | A | * | 8/1992 | Shipman | 15/DIG. 1 |
| 5,909,755 | A | | 6/1999 | Leal | |
| 6,049,944 | A | | 4/2000 | Lopez | |
| 6,199,244 | B1 | * | 3/2001 | Hilgers et al. | 15/1.51 |
| 6,370,731 | B1 | * | 4/2002 | Carter | 15/396 |

* cited by examiner

*Primary Examiner*—Theresa T. Snider

(57) ABSTRACT

A suction-assisted dust mop enables dust to be efficiently attracted to the mop pile surface and held in place during cleaning. An electric motor powered blower or fan connected to a hollow tube generates a suction for cleaning dust at multiple suction holes in the tube walls which in turn generates suction in the fiber pile of the dust mop covering the suction holes. Chemical agents and/or an electrostatically charged fiber pile function along with suction to improve the efficiency of the dust cleaning process.

16 Claims, 3 Drawing Sheets

SUCTION-ASSISTED DUSTING DEVICE

This application claims the benefit of U.S. Provisional Application No. 60/206,296 filed on May 23, 2000.

BACKGROUND OF THE INVENTION

The Powerduster is a lightweight portable electric appliance powered by rechargeable batteries optimized for gently and efficiently dusting a variety of surfaces. Suction increases the efficiency of the dusting process by attracting dust to the Powerduster dust gathering fiber pile while the fiber pile is moved over surfaces requiring cleaning. Suction is applied in the present invention in combination with a chemical dust retaining compound and/or an electrostatic charge to the fiber pile to maximize dust gathering and retention. The Powerduster maximizes dust retention on the fiber pile while minimizing the intake of dust particles into the appliance. This increased efficiency decreases the amount of time required for dusting since less movement of the fiber pile over surfaces is required to pickup deposits of dust. Larger surface areas can be dusted in the same amount of time in comparison with conventional non-suction dusting devices.

Since suction attracts dust to the surface of the Powerduster dusting fiber pile and holds it in place while cleaning, dust is not spread around as in the use of conventional dusting devices. Persons with dust allergies can particularly benefit from the increased dust gather capabilities of the Powerduster.

PRIOR ART

Existing electric powered suction cleaning devices (vacuum cleaners) are designed to suck dirt and dust into a receptacle for storage and when the receptacle becomes full the dirt is emptied. In contrast, the Powerduster uses suction to attract dust particles to the surface of a fiber pile and hold the dust particles in place on and in the fiber pile until the pile is either cleaned or replaced. The Powerduster does not use suction to transfer dust to a receptacle for storage but instead uses suction to attract and hold dust particles to a fiber pile so that dust is not spread around during cleaning.

Non-suction dust cleaning devices in the prior art consist of soft fibers or feathers attached to a handle which when moved over furniture, blinds and other surfaces pick up dust or move the dust particles onto the floor where a vacuum cleaner later picks them up.

SUMMARY OF THE INVENTION

It the object of the present invention to provide a dusting appliance which can accomplish the task of attracting dust to a fiber pile using suction generated by a motor-powered blower and holding the gathered dust on the fiber pile using the assistance provided by suction. In addition, it is the object of the present invention to combine chemical agents and/or an electrostatic charge along with suction to the same fiber pile to enhance dust gathering and dust retention capabilities.

The present invention provides a lightweight handheld cleaning appliance powered by rechargeable batteries which can pick up dust from a variety of surfaces. The duster, which includes the dust gathering fiber pile, detaches from the extension tube for easy cleaning or replacement.

DETAILED DESCRIPTION OF THE PREFERRED EMBODIMENTS

Figure 1:
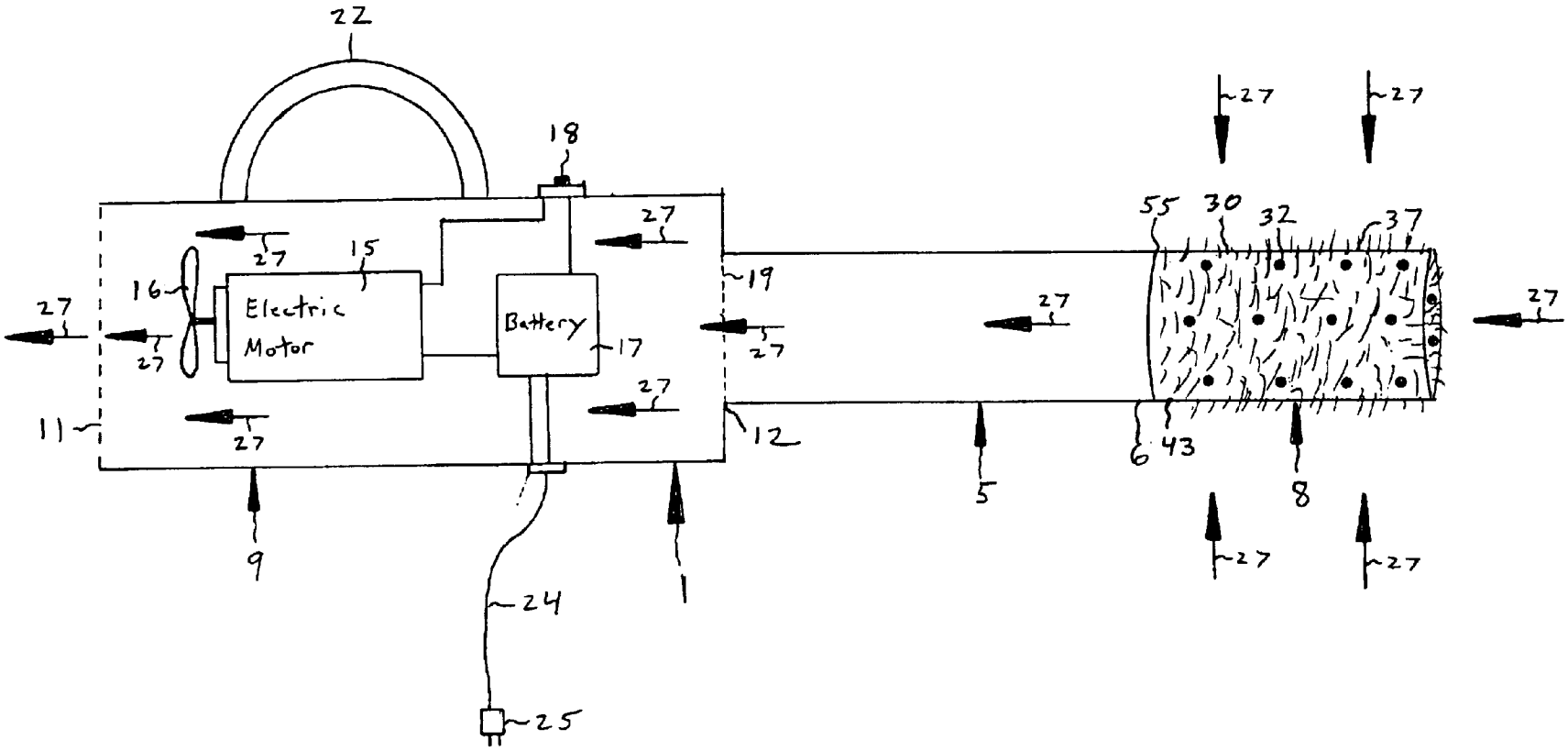
FIG. 1 is an overall view showing the main components of the preferred embodiment of the suction-assisted dusting appliance present invention.

Reference will now be made in detail to the present preferred embodiments of the invention, examples of which are illustrated in the accompanying drawings, wherein like reference numerals in the text indicate like elements throughout the drawings.

The Powerduster 1 illustrated in FIG. 1 consists of a hollow extension tube 5 fabricated of plastic, carbon fiber, plastic composite, metal or some other material, a removable dust gathering duster 8 which attaches to end 6 of tube 5 and a suction producing fan or blower 16 powered by electric motor 15 at end section 9 of tube 5. Electric motor 15, fan or blower 16, filter 19 and batteries 17 are housed in removable section 9 of tube 5. The length of hollow extension tube 5 is adjustable enabling the distance of the attached duster 8 from vacuum motor 15 to be increased or decreased. Extension tube 5 can either be rigid or flexible.

Figure 2:
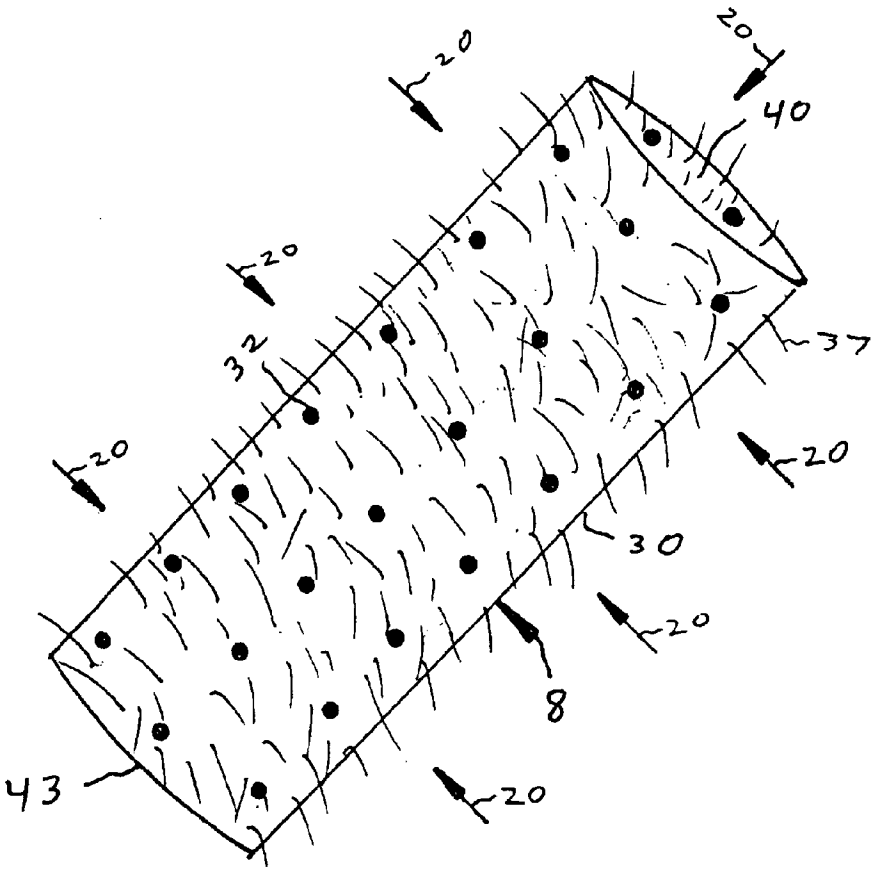
FIG. 2 illustrates the duster element of the present invention which attracts and hold dust using the assist provided by suction.

As illustrated in FIG. 2, duster 8 consists of hollow tube 30 which has multiple suction holes 32 distributed around the surface of tube 30 wall and end 40. Tube 30 end 40 is capped or closed to generate suction 20 at holes 32. However, suction holes 32 may be fabricated in cap or closed end 40 of tube 30, enabling suction to extend to any fiber pile covering end 40. Suction holes 32 are dispersed throughout the area covered by fiber pile 37 or duster 8. The other end 43 of tube 30 attaches to or connects with end 6 of extension tube 5. The connection joint 55 between duster 8 tube end 43 and tube end 6 can be rigid so that duster 8 does not have the ability to rotate or can be designed to enable duster 8 to rotate. More expensive commercial models of the Powerduster can use an electric motor to rotate duster 8 attached, engaged or connected to joint 55. A soft or semi-soft fibrous dust gathering material 37 is attached to or covers tube 30 to form duster 8. Fiber pile 37 covers suction holes 32 so that suction 20 is created in pile 37 when electric motor 15 driven fan or blower 16 is operating. Fiber pile 37 can be removable from tube 30 or permanently attached to tube 30 using an adhesive or other fastening method.

Figure 3:
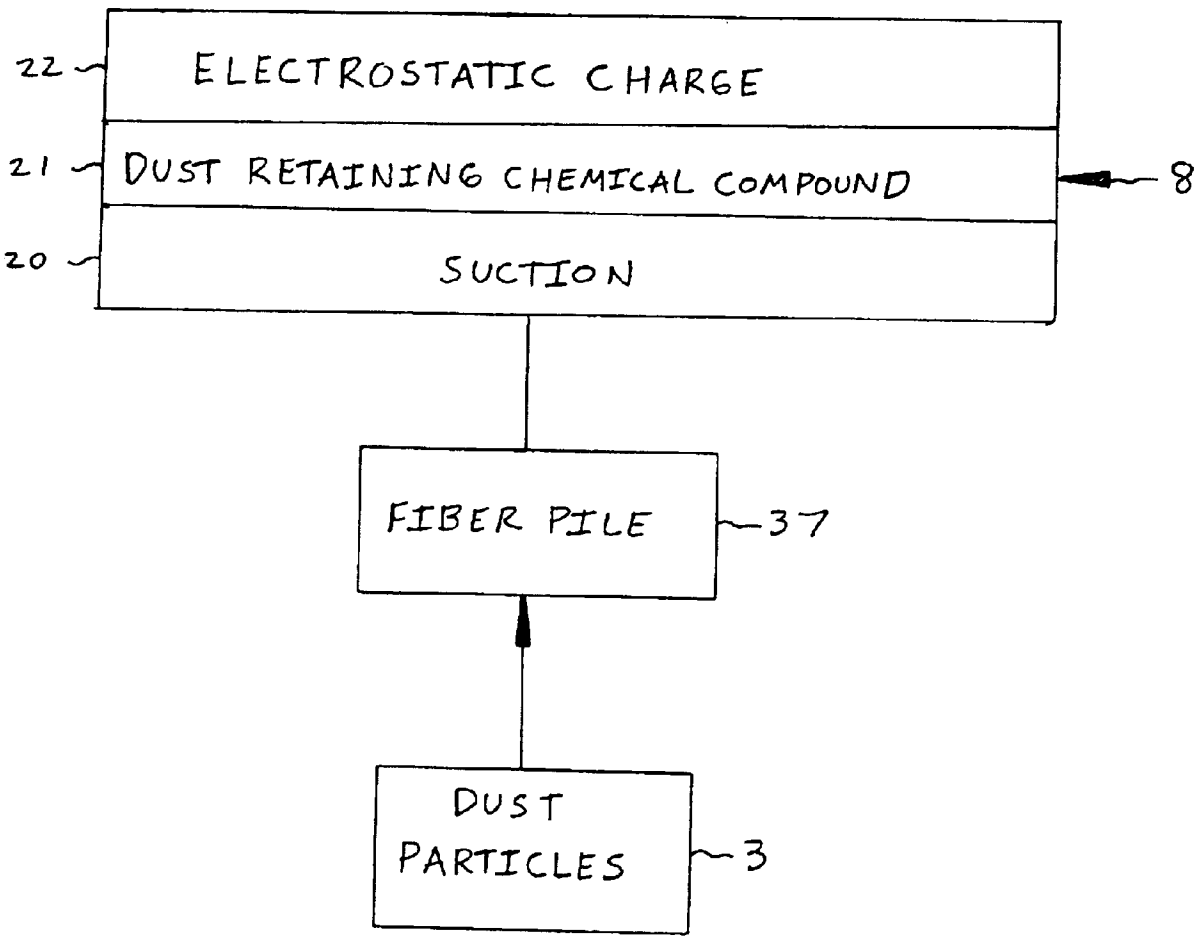
FIG. 3 illustrates the combined application of an electrostatic charge and/or dust retaining chemical compound along with suction to attract and retain dust particles on and in the fiber pile of the present invention.

As illustrated in FIG. 3, in the present invention, along with the application of suction 20 a dust retaining chemical compound 21 is added to the fibers 37 of duster 8 to enhance dust 3 sticking to fibers 37 and/or an electrostatically charged 22 fiber pile 37 assists in retaining and holding dust on and in fiber pile 37. Fiber pile 37 may be composed of fibers which generate an electrostatic charge 22 or a circuit which includes batteries 17 may actively generate an electrostatic charge 22 in fiber pile 37 by passing an electric current through conductive fibers mixed into fiber pile 37. Combining the application of a chemical agent 21 and/or an electrostatic charge 22 along with suction 20 generated by a blower or fan mechanism to fiber pile 37 increases the capability to attract dust and retain the dust on fiber pile 37 in comparison to using the chemical agent 21, electrostatic charge 22 or suction 20 method alone.

The fibrous dust gathering material 37 is positioned over the suction holes of tube 30. Duster 8 dust gathering fiber pile 37 can consist of long soft fluffy fibers or short fibers and the fibers may be curly or straight. Fiber pile 37 may be woven as a fabric or unwoven with multiple fiber strands forming a fluffy dust gathering surface. Duster 8 can be fabricated so it is either disposable or an embodiment can be manufactured that enables attached dust to be easily cleaned off and duster 8 reused.

Electric motor 15 which drives fan or blower 16 is powered by rechargeable batteries 17 thus enabling the Powerduster 1 to perform multiple dust cleaning tasks around the house or office. When electric motor 15 powered fan or blower 16 is operating and creating suction 20 at holes 32, the suction 20 results in the attraction of dust particles 3 to the fibrous dust gathering pile 37 where the dust particles 3 are retained in fiber pile 37. Even when electric motor 15 and fan or blower 16 are turned off, dust 3 will continue to be retained by fibrous dust gathering pile 37 until cleaning of duster 8 takes place, or in the case of a disposable duster 8, until the duster 8 is removed and disposed of in a bag. End 9 section of extension tube 5, which is where electric motor 15 and fan or blower 16 are housed, detaches from extension tube 5 at connection 12 enabling a removable filter or screen 19 to be periodically replaced or cleaned. Filter or screen 19 catches any stray dust particles 3 which may enter the appliance and prevents dust from building up in the space where electric motor driven fan or blower 16 is housed. As an alternative, dust screen or filter 19 may be located at connection joint 55. On/Off switch 18 turns electric motor 15 on or off.

When electric motor 15 powered fan or blower 16 is operating, suction 20 is created inside tubes 5 and 30, at holes 32 and in the fiber pile 37 of duster 8. Fan or blower 16, moves air 27 through holes 32 to create suction 20 in fiber pile 37 and expels the air 27 through vents 11 at one end of motor drive and blower assembly 9. The suction 20 at holes 32 creates suction 20 in fibrous dust gathering pile 37 which attracts and retains dust particles 3. In the present invention, suction 20 power should be at a level where the fiber pile 37 does not flatten out or where the fiber pile 37 is sucked into suction holes 32. In addition, suction 20 should be at a low enough level to minimize the sucking of dust 3 into the appliance while at the same time being at a level where dust particles 3 are attracted to and retained on fiber pile 37. Higher levels of suction force may be used with fiber pile 37 composed of short fibers or a woven fabric.

The suction 20 power of the Powerduster 1 can be varied by scaling up the size and surface area of the dust pile while at the same time increasing the power of motor powered fan or blower 16. A carrying handle 22 can be added to housing 9 which attaches to tube 5 where the electric motor 15 blower 16 and battery pack 17 are located to facilitate ease of handling. Motor 15, besides being powered by batteries 17, can also be powered by plug in cord 24 and Direct Current (DC) and voltage step down transformer 25 which plugs into a standard electrical wall outlet. Cord 24 and transformer 25 also supplies the power to recharge batteries 17.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A removable attachment for a vacuum cleaning device, comprising;

a hollow cavity with one or more openings in a wall of said hollow cavity;

a fiber pile consisting of fibers covering, bordering, or in close proximity to said one or more openings in said wall;

fibers included in said fiber pile having electrostatic properties operable for attracting and retaining dust thereto;

whereby, when said removable attachment is attached to a vacuum cleaning device that includes an electrically-powered suction means, the suction air flow created by said suction means in and near said one or more openings results in the attraction of dust to said one or more openings and the electrostatic properties of said fibers results in the attraction to and retention of dust onto said fiber pile as said removable attachment passes over a surface during cleaning.

2. The removable attachment for a vacuum cleaning device as recited in claim 1, wherein said fibers of said fiber pile are curly, straight or woven.

3. A removable attachment for a vacuum cleaning device, comprising;

a hollow cavity with one or more openings in a wall of said hollow cavity;

a fiber pile consisting of fibers covering, bordering, or in close proximity to said one or more openings in said wall;

a chemical additive having adhesive or electrostatic properties included in said fiber pile operable for attracting and retaining dust thereto;

whereby, when said removable attachment is attached to a vacuum cleaning device that includes an electrically-powered suction means, the suction air flow created by said suction means in and near said one or more openings results in the attraction of dust to said one or more openings and the adhesive or electrostatic properties results in the attraction to and retention of dust onto said fiber pile as said removable attachment passes over a surface during cleaning.

4. The removable attachment for a vacuum cleaning device as recited in claim 3, wherein said fibers of said fiber pile are curly, straight or woven.

5. A vacuum cleaning device, comprising:

one or more suction holes in a wall of a housing;

suction means in said housing operable for creating a suction air flow in and near said one or more suction holes;

a fiber pile consisting of fibers covering, bordering, or in close proximity to said one or more suction holes;

a chemical additive having adhesive and/or electrostatic properties included in said fiber pile operable for attracting and retaining dust thereto;

an electric power means in or connected to said housing operable for powering said suction means;

whereby, the suction air flow created by said suction means and the adhesive and/or electrostatic properties results in the attraction to and retention of dust onto said fiber pile.

6. The vacuum cleaning device as recited in claim 5, wherein said fibers of said fiber pile are curly, straight or woven.

7. A vacuum cleaning device, comprising:

one or more suction holes in a wall of a housing;

suction means in said housing operable for creating a suction air flow in and near said one or more suction holes;

a fiber pile consisting of fibers covering, bordering, or in close proximity to said one or more suction holes which includes fibers having electrostatic properties operable for attracting and retaining dust thereto;

an electric power means in or connected to said housing operable for powering said suction means;

whereby, the suction air flow created by said suction means and the electrostatic properties of said fibers results in the attraction to and retention of dust onto said fiber pile.

8. The vacuum cleaning device as recited in claim 7, wherein said fibers of said fiber pile are curly, straight or woven.

9. A vacuum cleaning device for collecting dust, comprising:

one or more suction holes in a wall of a housing;

a removable fiber pile that covers, borders or is in close proximity to said one or more suction holes;

a suction means in said housing operable for creating a suction air flow in and near said one or more suction holes and removable fiber pile;

an electric power means in or connected to said housing operable for powering said suction means;

a chemical additive having adhesive or electrostatic properties included in said removable fiber pile operable for attracting and retaining dust thereto;

whereby, the suction air flow created by said suction means and the adhesive or electrostatic properties results in the attraction to and retention of dust onto said removable fiber pile.

10. The vacuum cleaning device as recited in claim 9, wherein said removable fiber pile has curly, straight or woven fibers.

11. A vacuum cleaning device for collecting dust, comprising:

one or more suction holes in a wall of a housing;

a removable fiber pile that borders or is in close proximity to said one or more suction holes;

a suction means in said housing operable for creating a suction air flow in and near said one or more suction holes;

an electric power means in or connected to said housing operable for powering said suction means;

fibers included in said removable fiber pile having electrostatic properties operable for attracting and retaining dust thereto;

whereby, the suction air flow created by said suction means results in the sucking of dust into said one or more suction holes and the electrostatic properties of said removable fiber pile results in the attraction to and retention of dust onto said removable fiber pile as the said one or more suction holes and removable fiber pile of said vacuum cleaning device pass over a surface during cleaning.

12. The vacuum cleaning device for collecting dust as recited in claim 11, wherein said fibers of said removable fiber pile are curly, straight or woven.

13. A vacuum cleaning device for collecting dust, comprising:

one or more suction holes in a wall of a housing;

a removable fiber pile that borders or is in close proximity to said one or more suction holes;

a suction means in said housing operable for creating a suction air flow in and near said one or more suction holes;

an electric power means in or connected to said housing operable for powering said suction means;

a chemical additive included in said fiber pile having adhesive or electrostatic properties operable for attracting and retaining dust;

whereby, the suction air flow created by said suction means results in the sucking of dust into said one or more suction holes and the adhesive and/or electrostatic properties of said removable fiber pile results in the attraction to and retention of dust onto said removable fiber pile as the said one or more suction holes and removable fiber pile of said vacuum cleaning device pass over a surface during cleaning.

14. The vacuum cleaning device for collecting dust as recited in claim 13, wherein said removable fiber pile has curly, straight or woven fibers.

15. A vacuum cleaning device for collecting dust, comprising:

one or more suction holes in a wall of a housing;

a removable fiber pile that borders or is in close proximity to said one or more suction holes;

a suction means in said housing operable for creating a suction air flow in and near said one or more suction holes;

an electric power means in or connected to said housing operable for powering said suction means;

an on and off switch connected to said housing operable for turning said suction means on and off during cleaning;

fibers included in said removable fiber pile having electrostatic properties operable for attracting and retaining dust;

whereby, when said on and off switch is in the on position the suction air flow created by said suction means results in the sucking of dust into said one or more suction holes, and when the said on and off switch is in the off position the electrostatic properties of said removable fiber pile results in the attraction to and retention of dust onto said removable fiber pile as the said one or more suction holes and removable fiber pile of said vacuum cleaning device pass over a surface during cleaning.

16. A vacuum cleaning device for collecting dust, comprising:

one or more suction holes in a wall of a housing;

a removable fiber pile that borders or is in close proximity to said one or more suction holes;

a suction means in said housing operable for creating a suction air flow in and near said one or more suction holes;

an electric power means in or connected to said housing operable for powering said suction means;

an on and off switch connected to said housing operable for turning said suction means on and off during cleaning;

a chemical additive included in said fiber pile having adhesive or electrostatic properties operable for attracting and retaining dust thereto;

whereby, when said on and off switch is in the on position the suction air flow created by said suction means results in the sucking of dust into said one or more suction holes, and when the said on and off switch is in the off position the adhesive or electrostatic properties of said removable fiber pile results in the attraction to and retention of dust onto said removable fiber pile as the said one or more suction holes and removable fiber pile of said vacuum cleaning device pass over a surface during cleaning.

* * * * *